US006006810A

United States Patent [19]

Malott

[11] Patent Number: 6,006,810

[45] Date of Patent: Dec. 28, 1999

[54] AWNING SUPPORT FOR MOUNTING TO A CURVED WALL

[75] Inventor: Dale G. Malott, Middlebury, Ind.

[73] Assignee: White Consolidated Industries, Inc., Cleveland, Ohio

[21] Appl. No.: 09/130,284

[22] Filed: Aug. 6, 1998

[51] Int. Cl.[6] ..... E04F 10/06

[52] U.S. Cl. ..... 160/67; 160/71

[58] Field of Search ..... 160/67, 66, 22, 160/69, 71, 72, 80, 78; 135/88.12, 88.11

[56] References Cited

U.S. PATENT DOCUMENTS

| | | | |
|---|---|---|---|
| 1,401,382 | 12/1921 | Whitish . | |
| 1,777,778 | 10/1930 | Zecher . | |
| 3,324,869 | 6/1967 | Duda . | |
| 3,866,874 | 2/1975 | Upton, Jr. . | |
| 3,870,096 | 3/1975 | Horrell . | |
| 3,918,510 | 11/1975 | Hayward . | |
| 3,918,511 | 11/1975 | Upton, Jr. . | |
| 3,980,121 | 9/1976 | McKee . | |
| 4,117,876 | 10/1978 | Bennett . | |
| 4,195,877 | 4/1980 | Duda . | |
| 4,576,192 | 3/1986 | Duda . | |
| 4,819,707 | 4/1989 | Watson et al. . | |
| 5,148,848 | 9/1992 | Murray et al. | 160/67 |
| 5,171,056 | 12/1992 | Faludy et al. . | |
| 5,172,743 | 12/1992 | Wallace et al. | 160/67 |
| 5,472,007 | 12/1995 | Malott . | |
| 5,560,412 | 10/1996 | Murray . | |
| 5,697,417 | 12/1997 | Spoon | 160/71 |

*Primary Examiner*—David M. Purol

*Attorney, Agent, or Firm*—Pearne, Gordon, McCoy & Granger LLP

[57] ABSTRACT

An awning assembly for mounting to a curved wall. The awning assembly includes a canopy secured to a roller assembly. The roller assembly is supported by a pair of extensible support arms and a pair of extensible rafters. Each of the support arms includes upper and lower arms locked together by a locking assembly. Inner ends of the rafter are pivotably connected to upper brackets adapted for mounting to the wall. Outer ends of the rafters are slidably and pivotably connected to the support arms. The support arms and the rafters are curved so as to conform to the wall when the awning assembly is in a stored position. Pins extending from the upper brackets space the support arms from the wall when the awning assembly is in the stored position.

18 Claims, 8 Drawing Sheets

AWNING SUPPORT FOR MOUNTING TO A CURVED WALL

BACKGROUND OF THE INVENTION

This invention relates to retractable awnings in general and, more particularly, to an awning support for mounting to a curved wall.

A conventional retractable awning includes a fabric canopy having an outer portion secured to a roller tube, and an inner portion secured to a vertical wall of a structure, such as a recreational vehicle. The roller tube is supported at its ends by a support structure comprised of a pair of support arms and a pair of rafters. Each end of the roller tube is supported by one of the support arms and one of the rafters. The support arms are connected between the ends of the roller tube and lower brackets attached to the wall, while the rafters are connected between the support arms and upper brackets attached to the wall.

Conventionally, the support structure is movable between a stored position, wherein the support arms and rafters are vertically disposed adjacent to the wall, and an employed position, wherein the support arms and the rafters extend away from the wall. When the support structure is in the stored position, the canopy is rolled up around the roller tube to form an awning roll. In addition, the rafters are usually disposed inside of the support arms and upper ends of the support arms are usually secured to the wall to maintain the support structure in the stored position.

Conventionally, the support arms and the rafters are straight. This construction is suitable for a planar wall, but not a curved wall. Some prior art support structures are constructed for mounting to a curved wall. Many of these support structures, however, do not closely conform to the contour of the side wall when they are in the stored position. In addition, in these support structures, the awning roll typically rests against the wall, which is undesirable because the awning roll can bounce against the wall when the recreational vehicle is moving, thereby damaging the wall.

Based upon the foregoing, there is a need in the art for an improved support structure for mounting to a curved wall. The present invention is directed to such a support structure.

SUMMARY OF THE INVENTION

It therefore would be desirable, and is an advantage of the present invention, to provide an improved awning assembly for mounting to a wall. In accordance with the invention, the awning assembly includes a canopy connected to a roller assembly. The canopy may be rolled up around the roller assembly. An upper bracket and a lower bracket are provided for securement to the wall. A support arm is provided having an upper end connected to the roller assembly and a lower end connected to the lower bracket. The support arm extends arcuately from the lower end to the upper end. A rafter is provided having an inner end connected to the upper bracket and an outer end slidably and pivotably connected to the support arm. The rafter extends arcuately from the inner end to the outer end.

Also provided in accordance with the present invention is an awning assembly having a lock assembly and a guard therefor. The awning assembly includes a roller assembly connected to a canopy and around which the canopy may be rolled. A lower bracket is provided for securement to a wall. A support arm assembly is provided having a lower arm telescopically received in an upper arm. The upper arm has an upper end connected to the roller assembly, and the lower arm has a lower end connected to the lower bracket. The lock assembly is connected to the support arm assembly. The lock assembly includes an actuator movable between a locking position, wherein the lock assembly prevents the upper arm and the lower arm from moving relative to each other, and an unlocking position, wherein the lock assembly allows the upper arm and the lower arm to move relative to each other. The guard is pivotably connected to the support arm assembly so as to be movable between an uncovering covering position, wherein the guard is spaced from the actuator so as to permit the actuator to be moved to the unlocking position, and a covering position, wherein the guard is disposed over the actuator so as to prevent the actuator from being moved to the unlocking position.

Also provided in accordance with the present invention is an awning assembly having a spacer pin. The awning assembly includes a canopy connected to a roller assembly. The canopy may be rolled up around the roller assembly. A lower bracket is provided for securement to a wall. A support arm is provided having a lower end connected to the lower bracket and an upper end connected to the roller assembly. The support arm is movable between a stored position, wherein the support arm helps support the roller assembly proximate to the wall, and an employed position, wherein the support arm helps support the roller assembly distal to the wall. An upper bracket is provided having a base adapted for mounting to the wall, and a mounting arm extending outwardly from the base. The mounting arm has the spacer pin extending laterally therefrom. The spacer pin contacts the support arm when the support arm is in the stored position, thereby spacing the support arm from the wall.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
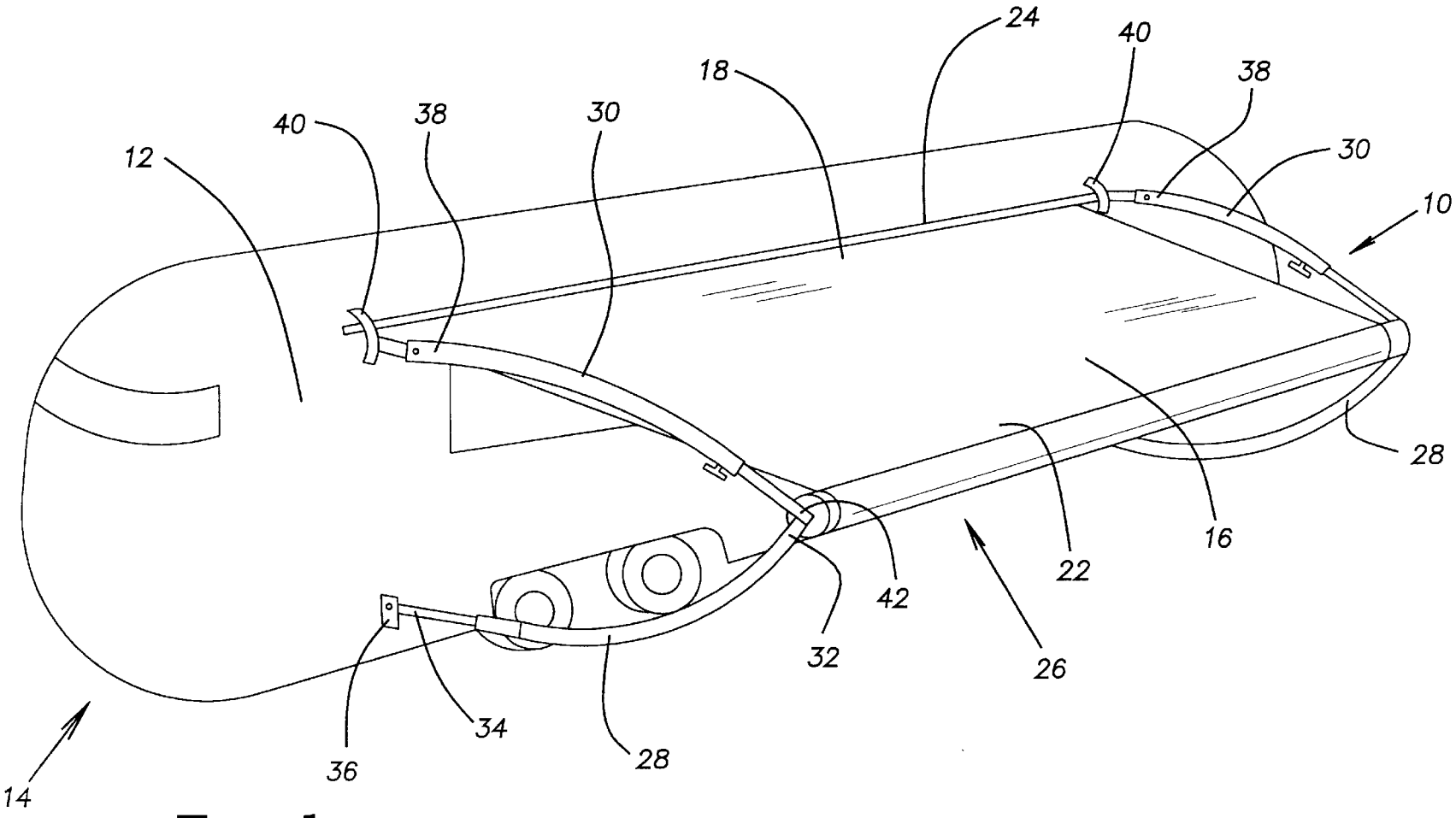
FIG. 1 shows a perspective view of an awning assembly in an employed position.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a perspective view of an awning assembly 10 in an extended or employed position. The awning assembly 10 is mounted to a wall 12 of a structure, such as a recreational vehicle 14. The wall 12 has a curved contour, extending arcuately from the bottom of the vehicle 14 to the top of the vehicle 14. As shown best in FIG. 2, the curvature of the wall 12 is greater toward the top of the vehicle 14, than toward the bottom of the vehicle 14.

The awning assembly 10 includes a rectangular canopy 16 composed of a fabric material. The canopy 16 includes an inner portion 18 having an inner spline 20 (shown in FIG. 3) formed therein and an outer portion 22 having at least one outer spline (not shown) formed therein. The inner spline 20 is secured to a rail 24 mounted on an upper portion of the wall 12 of the vehicle 14, while the outer spline is secured to a roller assembly 26.

The roller assembly 26 is supported by a pair of extensible support arms 28 and a pair of extensible rafters 30. The support arms 28 are mirror images of each other and have upper ends 32 connected to the roller assembly 26 and lower ends 34 pivotally secured to lower brackets 36 mounted on the wall 12 of the vehicle 14. The rafters 30 are mirror images of each other and have inner ends 38 pivotally secured to upper brackets 40 mounted on the wall 12 of the vehicle 14 and outer ends 42 slidingly and pivotably mounted to the support arms 28, as described in more detail below. The rafters 30, the support arms 28, the upper brackets 40, and the lower brackets 36 form a support structure that supports the roller assembly 26 for movement relative to the wall 12.

When the awning assembly 10 is in the employed position as shown in FIG. 1, the roller assembly 26 is spaced from the wall 12 and the canopy 16 is stretched out between the roller assembly 26 and the wall 12. When the awning assembly 10 is in a stored position (shown in FIG. 7), the canopy 16 is rolled up around the roller assembly 26 so as to form an awning roll 44, which is supported adjacent to the wall 12.

Figure 2:
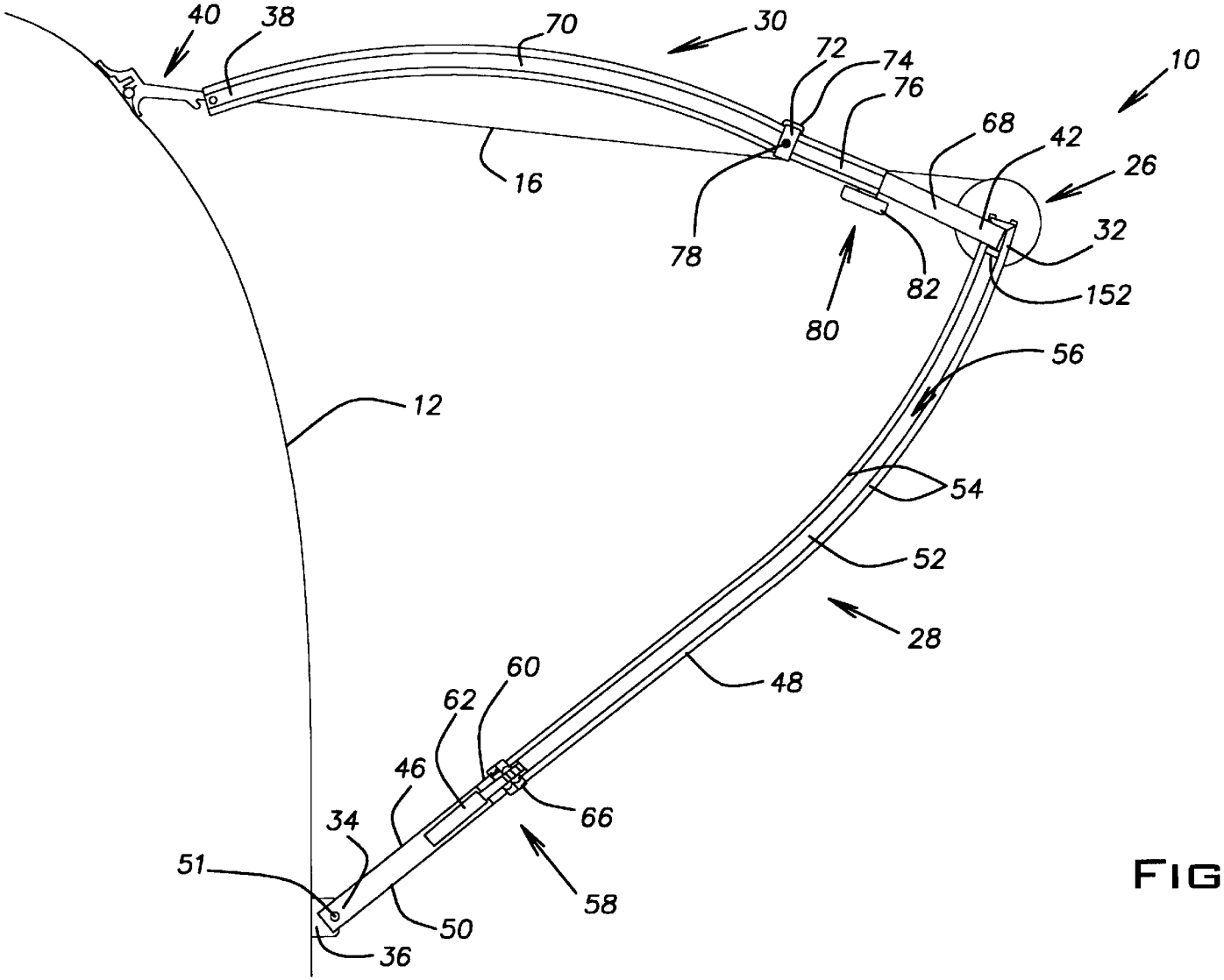
FIG. 2 shows a side view of the awning assembly in the employed position.
Figure 7:
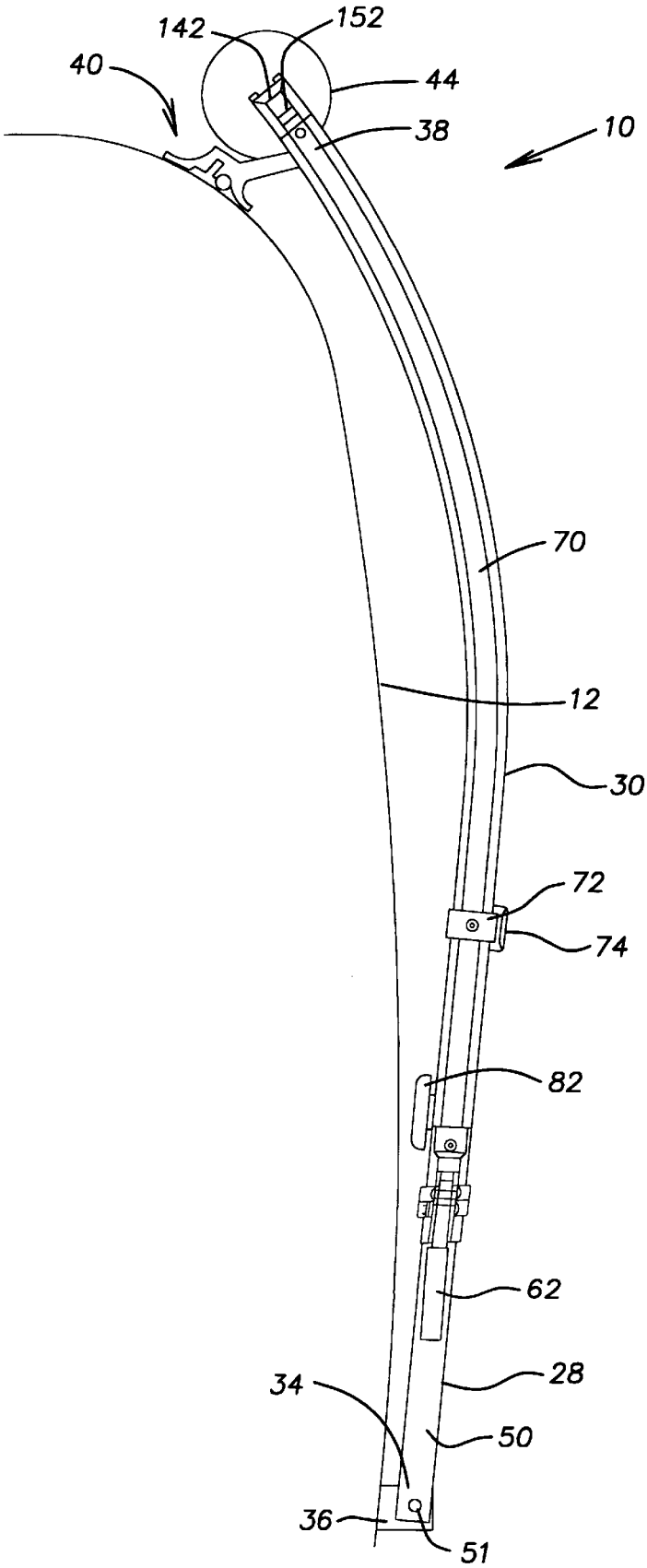
FIG. 7 shows a side view of the awning assembly in a stored position.

Referring now to FIG. 2, there is shown a side view of the awning assembly 10 in the employed position. Each of the support arms 28 includes a curved lower arm 46 telescopically received in a curved upper arm 48. Preferably, the lower arm 46 and the upper arm 48 are curved so as to conform to the curvature of the wall 12 when the awning assembly 10 is in the stored position, as shown in FIG. 7. The lower arm 46 and the upper arm 48 each have a rectangular cross-section. The lower arm 46 includes the lower end 34 and an outer side wall 50 having a series of apertures 53 (shown in FIGS. 9, 10) formed therein. The lower arm 46 is pivotably connected to the lower bracket 36 by a pivot pin 51 that extends through the lower end 34. The upper arm 48 includes the upper end 32 and an outer side wall 52 having a pair of arm flanges 54 defining a longitudinal slide channel 56.

Figure 9:
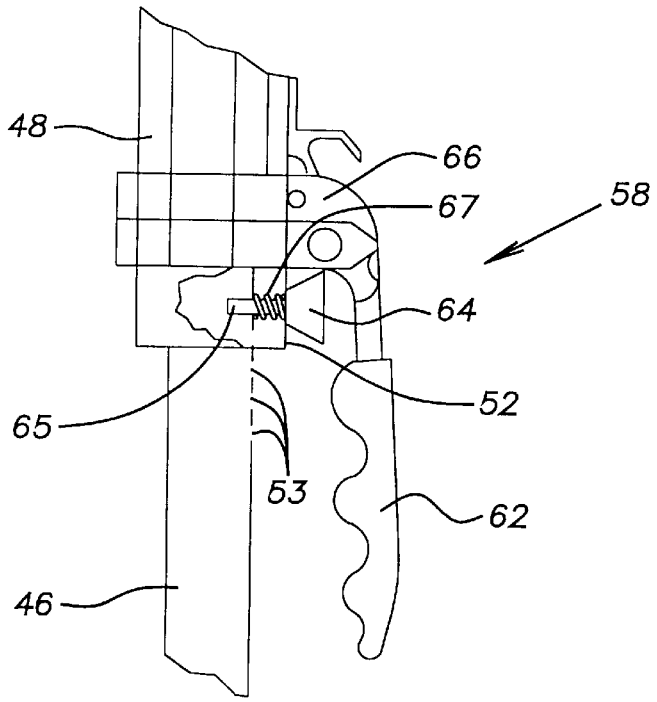
FIGS. 9 and 10 each show an enlarged view of a portion of FIG. 8.
Figure 10:
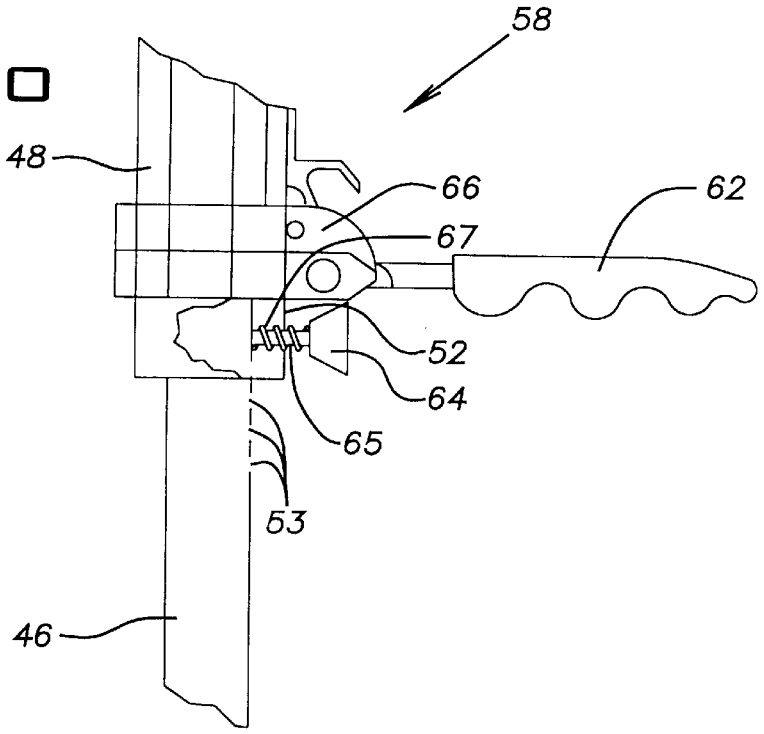

The lower arm 46 and the upper arm 48 are releasably locked to each other by a locking assembly 58 located toward a lower end 60 of the upper arm 48. With reference now to FIGS. 9 and 10, the locking assembly 58 includes a lever 62, and a plunger 64 secured to a locking pin 65. The locking pin 65 extends through an opening in the outer side wall 52 of the upper arm 48. The plunger 64 is movable between a first or locking position (shown in FIG. 9), wherein the plunger 64 is disposed proximate to the outer side wall 52, and a second or unlocking position (shown in FIG. 10), wherein the plunger 64 is disposed distal to the outer side wall 52. When the plunger 64 is in the locking position, the locking pin 65 extends through one of the apertures 53 of the lower arm 46, thereby preventing the lower and upper arms 46, 48 from moving relative to each other. When the plunger 64 is moved to the unlocking position, the locking pin 65 is retracted through the aperture 53, thereby allowing the lower and upper arms 46, 48 to move relative to each other. The plunger 64 is biased by a spring 67 toward the locking position.

The lever 62 is pivotably connected to a bracket 66 secured to the upper arm 48, above the plunger 64. The lever 62 is pivotable between a first or covering position (shown in FIG. 9), wherein the lever 62 is disposed substantially parallel to the upper arm 48, and a second or uncovering position (shown in FIG. 10), wherein the lever 62 extends away from the support arm 28 at about a right angle. When the lever 62 is in the uncovering position, the lever 62 is spaced from the plunger 64, thereby allowing the plunger 64 to be moved to the unlocking position. When the lever 62 is in the covering position, the lever 62 extends over the plunger 64, thereby preventing the plunger 64 from being moved to the unlocking position. In this manner, the lever 62 helps prevent the plunger 64 from inadvertently being moved to the unlocking position.

When the lever 62 is in the uncovering position, the lever 62 may be gripped by an operator and used as a handle to extend or retract the upper arm 48. In this manner, the lever 62 functions as both a guard and a handle.

Each of the rafters 30 includes a curved outboard rafter 68 telescopically received in a curved inboard rafter 70. Preferably the inboard rafter 70 and the outboard rafter 68 are curved so as to conform to the curved contour of the wall 12 when the awning assembly 10 is in the stored position. The inboard rafter 70 and the outboard rafter 68 each have a rectangular cross-section.

The inboard rafter 70 includes the inner end 38, while the outboard rafter 68 includes the outer end 42. A strap 72 fitted with a clasp assembly 74 is secured to an outer side wall 76 of the inboard rafter 70 by a screw 78 or other fastening means. Preferably, the strap 72 is composed of fabric.

The inboard rafter 70 and the outboard rafter 68 are releasably locked to each other by a knob assembly 80 located toward an outer end of the inboard rafter 70. The knob assembly 80 includes a knob 82 secured to a threaded shaft (not shown). The shaft threadably extends through an opening in a bottom wall 84 (shown in FIG. 8) of the inboard rafter 70. When the knob 82 is rotated in a first direction to a locking position, the shaft moves toward, and frictionally engages, a bottom wall of the outboard rafter 68, thereby preventing the outboard and inboard rafters 68, 70 from moving relative to each other. When the knob 82 is rotated in an opposite, second direction to an unlocking position, the shaft moves away from the bottom wall of the outboard rafter 68, thereby allowing the outboard and inboard rafters 68, 70 to move relative to each other.

Figure 3:
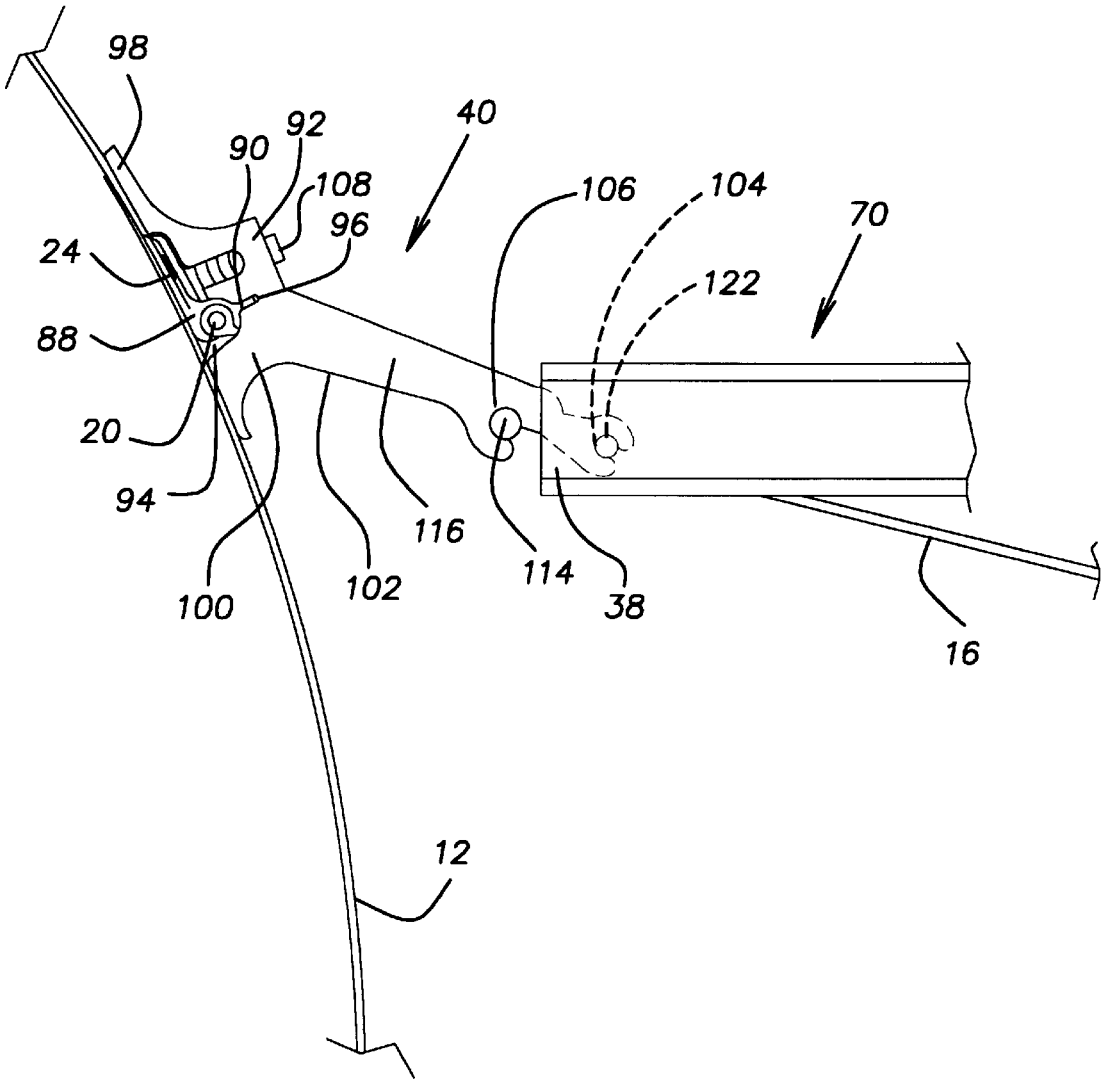
FIG. 3 shows a side view of a portion of an inboard rafter connected to an upper bracket.

Referring now to FIG. 3 there is shown an enlarged view of one of the inboard rafters 70 connected to one of the upper brackets 40. As will be described in more detail below, the upper bracket 40 is connected to the rail 24. The rail 24 is typically provided as part of the vehicle 14 by the manufacturer of the vehicle 14. The rail 24 includes a C-shaped channel 88 having a rain gutter 90 extending therefrom. In addition to carrying off rain water, the rain gutter 90 functions as a guide flange for the mounting of the upper bracket 40. The inner spline 20 of the canopy 16 is securely disposed inside the channel 88 of the rail 24.

Preferably, each of the upper brackets 40 has a construction substantially similar to the bracket disclosed in assignee's co-pending application, entitled "AWNING WITH RAIL MOUNTED RAFTER", Pearne, Gordon, McCoy and Granger Docket No. 30476, which is incorporated herein by reference. In accordance with this construction, each of the upper brackets 40 is preferably made of corrosion-resistant steel or other durable, rigid material, and includes a base 92 defining an enlarged recess 94. A narrow notch 96 is formed in the base 92 and extends from the enlarged recess 94. A top foot 98 extends upwardly from a top portion of the base 92, while a bottom foot 100 extends downwardly from a bottom portion of the base 92. The top foot 98 and the bottom foot 100 have bottom surfaces disposed at different angles in order to accommodate for the curvature of the wall 12. A mounting arm 102 extends outwardly and downwardly from the base 92, between the top foot 98 and the bottom foot 100. The mounting arm 102 has an outer portion defining first and second slots 104, 106.

The upper bracket 40 is disposed over the rail 24 such that the channel 88 is disposed in the recess 94 and the rain gutter 90 extends into the notch 96. The upper bracket 40 and the rail 24 are secured to the side wall 12 by a single bolt 108 that extends through the base 92 of the upper bracket 40 and the rail 24, and is threadably received in the wall 12. The bottom surfaces of the top and bottom feet 98, 100 abut the wall 12 of the vehicle 14.

A spacer pin 110 (shown best in FIG. 8) is attached to the mounting arm 102 of the upper bracket 40. Preferably, the spacer pin 110 has a spring body 112 (shown in FIG. 8). The spring body 112 has a free end 112*a* and is interference fit into the second slot 106 of the mounting arm 102. The body 112 extends away from the mounting arm 102 so as to space the free end 112*a* from an inner side 118 (shown in FIG. 8) of the mounting arm 102.

The inboard rafter 70 is pivotally connected to the mounting arm 102 of the upper bracket 40 by a pivot pin 122. The pivot pin 122 extends through the inner end 38 of the inboard rafter 70 and through the first slot 104 of the mounting arm 102.

Figure 4:
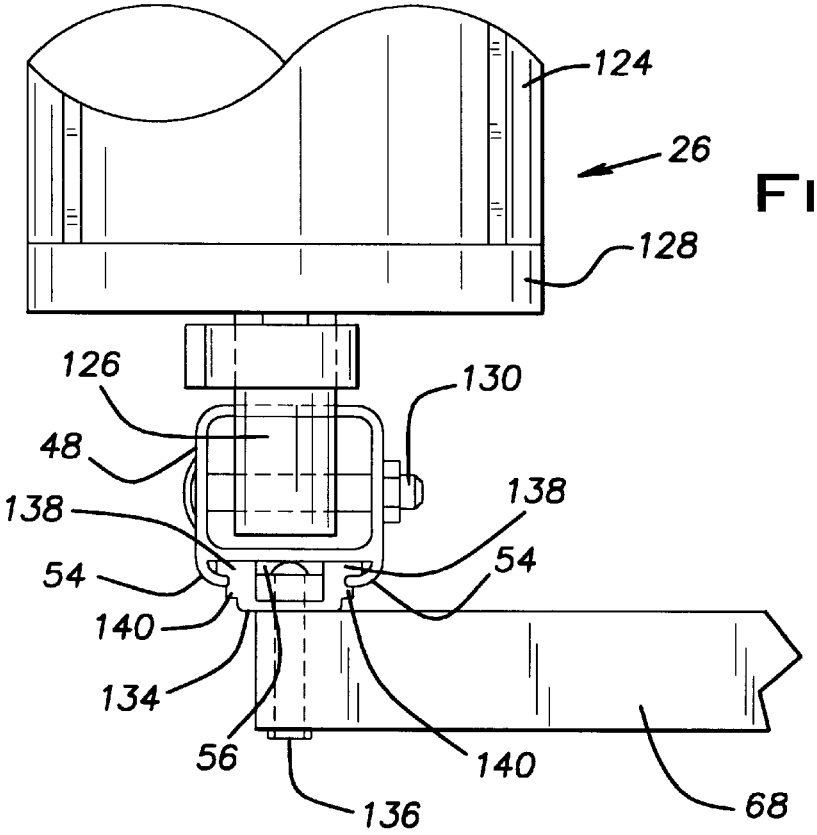
FIG. 4 shows a top view of an end of a roller assembly connected to an upper arm and an outboard rafter.
Figure 5:
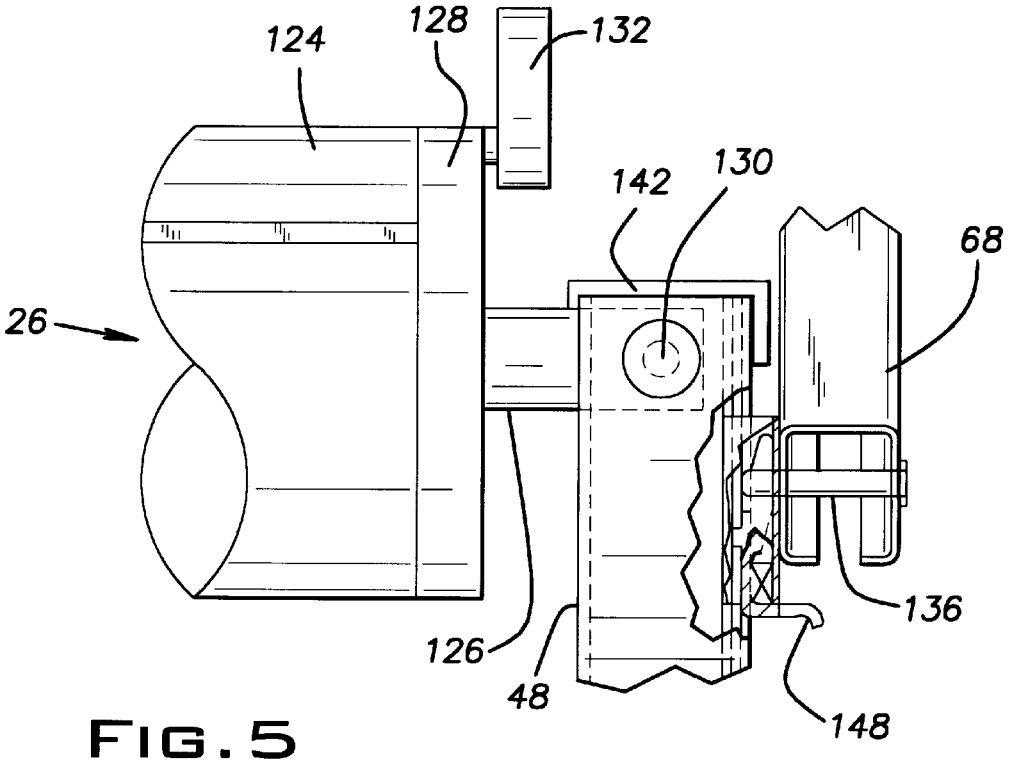
FIG. 5 shows a front view of the roller assembly connected to the upper arm and the outboard rafter.

Referring now to FIGS. 4 and 5, there is respectively shown a top view and a front view of an end of the roller assembly 26 connected to an upper arm 48 of one of the support arms 28 and an outboard rafter 68 of one of the rafters 30. Preferably, the roller assembly 26 has a construction substantially similar to the roller assembly 26 disclosed in assignee's recently allowed application, entitled "RETRACTABLE AWNING WITH IMPROVED ASSEMBLY FEATURES", Ser. No. 08/408,212, which is incorporated herein by reference. In accordance with this construction, the roller assembly 26 includes a roller tube 124 rotatably supported on a torsion rod 126, which can be solid or hollow. The torsion rod 126 extends longitudinally through the center of the roller tube 124 and through end caps 128 disposed at ends of the roller tube 124. The torsion rod 126 defines collinear support and rotational axes of the roller tube 124. Ends of the torsion rod 126 are supported on the upper arm 48 and secured by a nut and bolt assembly 130.

Although not shown, idler bearings are rotatably mounted on the torsion rod 126 and support the roller tube 124 for rotation about the torsion rod 126. A coiled torsion spring connected between the torsion rod 126 and one of the idler bearings biases the roller tube 124 to rotate in a first direction that will roll the canopy 16 up around the roller tube 124. One of the end caps 128 is provided with a roller lock assembly that has a first mode of operation and a second mode of operation. In the first mode of operation, the lock assembly permits the roller tube 124 to rotate in the first direction and not in a second direction. In the second mode of operation, the lock assembly permits the roller tube 124 to rotate in the second direction and not in the first direction. The lock assembly is placed in the first and second modes of operation by manipulating a handle 132 that is accessible from the exterior of the roller assembly 26.

A slide plate 134 is pivotably mounted to the outer end of the outboard rafter 68 by a post 136, such as a rivet. The slide plate 134 is made of a durable, low friction material, such as plastic. The slide plate 134 has a pair of inner flanges 138 and a pair of outer flanges 140 that cooperate with the arm flanges 54 to retain the slide plate 134 in the slide channel 56 and permit longitudinal movement therein. A support arm cap 142 is disposed over the upper end 32 of the upper arm 48 to limit upward travel of the slide plate 134. When the slide plate 134 abuts the cap 142, the post 136 defines a pivot axis substantially collinear with the torsion rod 126 and the support axis of the roller tube 124.

Figure 6:
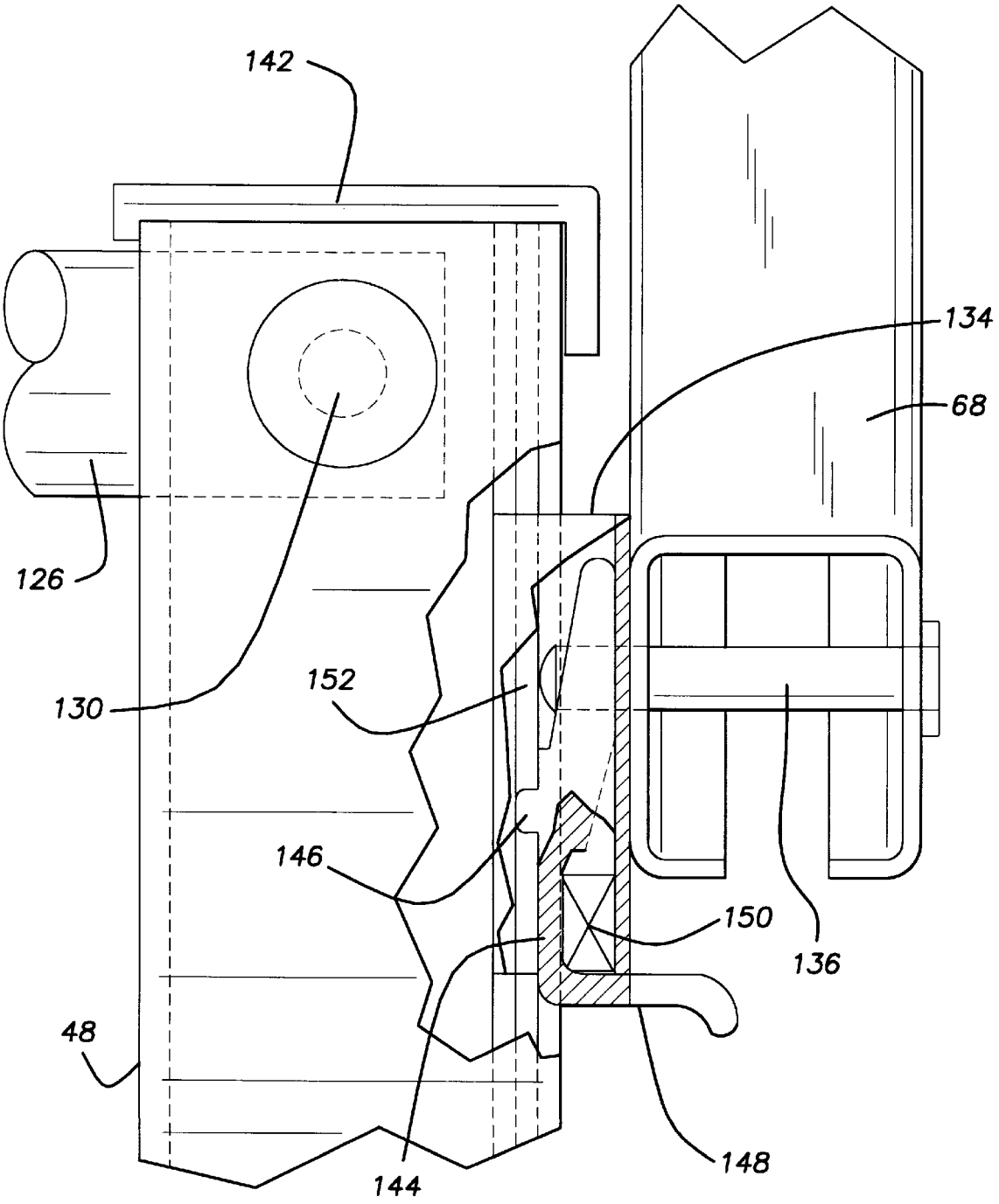
FIG. 6 shows an enlarged view of a portion of FIG. 5.

Referring now to FIG. 6, there is shown an enlarged view of a portion of Fig.5. A slider stop 144 is mounted on the post 136 between the slide plate 134 and the upper arm 48. The slider stop 144 has a detent 146 projecting from an inner face of the slider stop 144, toward the upper arm 48. An exposed end of the slider stop 144 defines a slide lever 148 projecting from behind the slide plate 134 to a location accessible to an operator. The detent 146 is biased toward the upper arm 48 by a compression spring 150, for example. A slot 152 adapted to receive the detent 146 is formed in the outer side wall 52 of the upper arm 48, toward the top of the slide channel 56. The slot 152 is positioned such that the detent 146 is biased into the slot 152 and locks the rafter 30 to the support arm 28 when the slide plate 134 abuts the support arm cap 142. The rafter 30 is unlocked from the support arm by actuating the slide lever 148 to remove the detent 146 from the slot 152.

With the rafters 30 connected to the support arms 28 in the manner described above, the outer ends 42 of the rafters 30 move along the lengths of the support arms 28 when the awning assembly 10 is moved between the stored position and the employed position, as will be described in more detail below.

In order to move the awning assembly 10 from the employed position to the stored position, the support arms 28 are first shortened by lifting the levers 62 to the uncovering position, moving the plungers 64 to the unlocking position, and moving the upper arms 48 over the lower arms 46, while holding the plungers 64 in the unlocking position. The plungers 64 are then released and the levers 62 moved to the covering position. Afterwards, the knobs 82 on the rafters 30 are rotated in the second direction to unlock the inboard rafters 70 from the outboard rafters 68. The slide levers 148 are actuated to unlock the rafters 30 from the support arms 28, and the outer ends 42 of the outboard rafters 68 are slid downwardly along the upper arms 48 until they reach the levers 62.

While the roller assembly 26 is held downward, the handle 132 is manipulated to place the lock assembly in the first mode of operation. The awning assembly 10 is then guided inward, toward the wall 12, as the canopy 16 rolls up around the roller tube 124. As the awning assembly 10 moves inward, the support arms 28 pivot upward about the lower bracket 36, and move toward the wall 12. The upward and inward movement of the support arms 28 continues until the support arms 28 contact the spacer pins 110 extending from the upper brackets 40. The spacer pins 110 space the support arms 28 and, thus, the roller assembly 26, from the wall 12 of the vehicle 14 so as to prevent the roller assembly 26 from contacting the wall 12.

After the support arms 28 are disposed against the spacer pins 110, the support arms 28 and the rafters 30 are fastened together using the straps 72. More specifically, each of the straps 72 is wrapped into a loop around its respective rafter 30 and support arm 28, and is secured in the loop by the clasp assembly 74. The knobs 82 on the rafters 30 are then rotated in the first direction to lock the inboard rafters 70 to the outboard rafters 68, thereby completing the movement of the awning assembly 10 to the stored position, as shown in FIGS. 7 and 8.

It should be appreciated that fastening the rafters 30 to the support arms 28 with the straps 72 prevents the roller assembly 26 from moving outward, away from the wall 12. It should also be appreciated that the spacer pins 110 prevent the roller assembly 26 from moving inward, toward the wall 12. In this manner, the roller assembly 26 is secured in the stored position.

Figure 8:
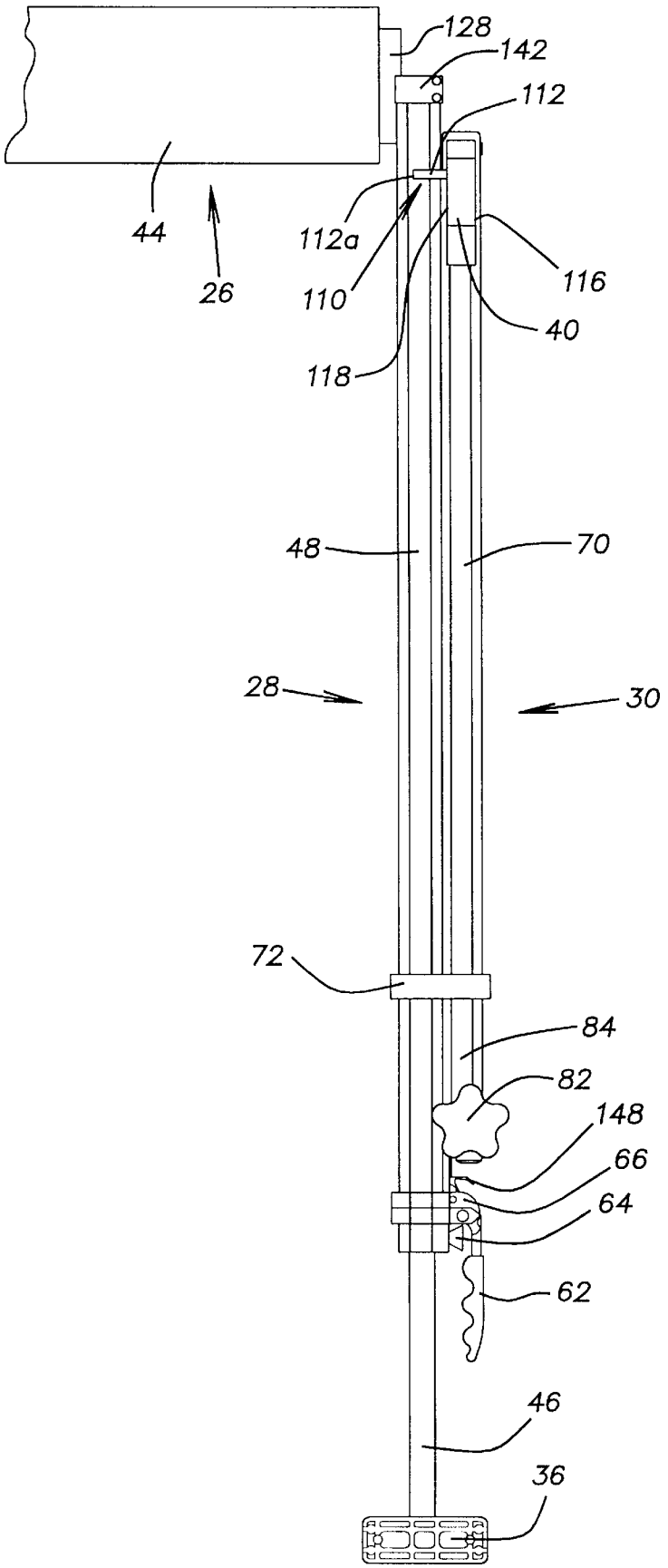
FIG. 8 shows a rear view of a portion of the awning assembly in the stored position.

Referring now to FIGS. 7 and 8, the awning assembly 10 is shown in the stored position. As shown in FIG. 7, the support arms 28 and the rafters 30 conform to the curvature of the wall 12. Toward the top of the awning assembly 10, the support arms 28 and the rafters 30 are only spaced from the wall 12 by about 1.5 inches. Toward the bottom of the awning assembly, the support arms 28 and the rafters 30 are spaced between 0.5 inches and 2.5 inches from the wall 12.

The curvature of the support arms 28 and the rafters 30 permits the roller assembly 26 to be stored close to the wall 12, which improves the aerodynamics and aesthetic appearance of the vehicle 14. The spacer pins 110, however, space the roller assembly 26 a sufficient distance from the wall 12 to prevent the roller assembly 26 from damaging the wall 12.

In order to move the awning assembly 10 from the stored position to the employed position, the clasp assemblies 74 are unfastened and the straps 72 unwrapped from the support arms 28 and the rafters 30. The knobs 82 on the rafters 30 are then rotated in the second direction to unlock the inboard rafters 70 from the outboard rafters 68. Afterwards, the handle 132 is manipulated to place the lock assembly in the second mode of operation. The roller assembly 26 and the support arms 28 are pulled away from the wall 12 and the canopy 16 unrolls from the roller tube 124. The outer ends 42 of the outboard rafters 68 are then slid upwardly along the upper arms 48 until the detents 146 of the slider stops 144 snap into the slots 152 of the upper arms 48. The knobs 82 on the rafters 30 are rotated in the first direction to lock the inboard rafters 70 to the outboard rafters 68. Finally, the support arms 28 are raised to a desired height by lifting the levers 62 to the uncovering position, moving the plungers 64 to the unlocking position, and extending the upper arms 48, while holding the plungers 64 in the unlocking position. The plungers 64 are then released and the levers 62 moved to the covering position.

Although the preferred embodiment of this invention has been shown and described, it should be understood that various modifications and rearrangements of the parts may be resorted to without departing from the scope of the invention as disclosed and claimed herein.

What is claimed is:

1. An awning assembly for mounting to a wall, said awning assembly comprising:

a canopy;

a roller assembly connected to the canopy and around which the canopy may be rolled;

upper and lower brackets for securement to the wall;

a support arm having an upper end connected to the roller assembly and a lower end connected to the lower bracket, said support arm extending arcuately from the lower end to the upper end; and a rafter having an inner end connected to the upper bracket and an outer end slidably and pivotably connected to the support arm, said rafter extending arcuately from the inner end to the outer end.

2. The awning assembly of claim 1, wherein the rafter comprises an outboard rafter telescopically received in an inboard rafter, said outboard rafter having the outer end, and said inboard rafter having the inner end.

3. The awning assembly of claim 1, wherein the support arm comprises a lower arm telescopically received in an upper arm, said lower arm having the lower end, and said upper arm having the upper end.

4. The awning assembly of claim 3 further comprising:

a lock assembly connected to the support arm, said lock assembly including an actuator movable between a locking position, wherein the lock assembly prevents the upper arm and the lower arm from moving relative to each other, and an unlocking position, wherein the lock assembly allows the upper arm and the lower arm to move relative to each other.

5. The awning assembly of claim 4 further comprising:

a guard pivotably connected to the support arm so as to be movable between an uncovering covering position, wherein the guard is spaced from the actuator so as to permit the actuator to be moved to the unlocking position, and a covering position, wherein the guard is disposed over the actuator so as to prevent the actuator from being moved to the unlocking position.

6. The awning assembly of claim 1, wherein the support arm is movable between a stored position, wherein the support arm helps support the roller assembly proximate to the wall, and an employed position, wherein the support arm helps support the roller assembly distal to the wall.

7. The awning assembly of claim 6, wherein the upper bracket has a base adapted for mounting to the wall, and a mounting arm extending outwardly from the base, said mounting arm having a pin extending laterally therefrom that contacts the support arm when the support arm is in the stored position, thereby spacing the support arm from the wall.

8. The awning of claim 7 further comprising a strap fitted with a clasp assembly, said strap being secured to the rafter and operable with the clasp assembly to secure the rafter and the support arm together when the support arm is in the stored position.

9. An awning assembly for mounting to a wall, said awning assembly comprising:

a canopy;

a roller assembly connected to the canopy and around which the canopy may be rolled;

a lower bracket for securement to the wall;

a support arm assembly having a lower arm telescopically received in an upper arm, said upper arm having an upper end connected to the roller assembly, and said lower arm having a lower end connected to the lower bracket, said lower arm having a plurality of apertures formed therein;

a lock assembly connected to the support arm assembly, said lock assembly including a locking pin extending through the upper arm and connected to an actuator adapted for direct manipulation by an operator, said actuator being movable between a locking position, wherein the locking pin extends through one of the apertures of the lower arm, thereby preventing the upper arm and the lower arm from moving relative to each other, and an unlocking position, wherein the locking pin is retracted through the aperture, thereby allowing the upper arm and the lower arm to move relative to each other, said actuator being proximate to the upper arm when the actuator is in the locking position, and said actuator being distal to the upper arm when the actuator is in the unlocking position; and a guard pivotably connected to the support arm assembly so as to be movable between an uncovering position, wherein the guard is spaced from the actuator so as to permit the actuator to be moved to the unlocking position, and a covering position, wherein the guard is disposed over the actuator so as to prevent the actuator from being moved to the unlocking position.

10. The awning assembly of claim 9, wherein the guard comprises a lever; and wherein the lever is disposed substantially parallel to the upper arm when the guard is in the covering position, and the lever extends away from the upper arm at about a right angle when the guard is in the uncovering position.

11. The awning assembly of claim 9, wherein the actuator is spring biased toward the locking position.

12. The awning assembly of claim 9 further comprising:

an upper bracket for securement to the wall; and a rafter having an inner end connected to the upper bracket and an outer end slidably and pivotably connected to the support arm assembly.

13. The awning assembly of claim 12, wherein the rafter and the support arm assembly are curved.

14. The awning assembly of claim 12, wherein the support arm assembly is movable between a stored position, wherein the support arm assembly helps support the roller assembly proximate to the wall, and an employed position, wherein the support arm assembly helps support the roller assembly distal to the wall; and wherein the upper bracket has a base adapted for mounting to the wall, and a mounting arm extending outwardly from the base, said mounting arm having a pin extending laterally therefrom that contacts the support arm assembly when the support arm assembly is in the stored position, thereby spacing the support arm assembly from the wall.

15. An awning assembly for mounting to a wall, said awning assembly comprising:

a canopy;

a roller assembly connected to the canopy and around which the canopy may be rolled;

a lower bracket for securement to the wall;

a support arm having a lower end connected to the lower bracket and an upper end connected to the roller assembly, said support arm being movable between a stored position, wherein the support arm helps support the roller assembly proximate to the wall, and an employed position, wherein the support arm helps support the roller assembly distal to the wall; and an upper bracket having a base adapted for mounting to the wall, and a mounting arm extending outwardly from the base, said mounting arm having a spacer pin extending laterally therefrom that contacts the support arm when the support arm is in the stored position, thereby spacing the support arm from the wall.

16. The awning assembly of claim 15 further comprising a rafter having an outer end connected to the support arm and an inner end pivotably connected to the mounting arm by a pivot pin.

17. The awning assembly of claim 16, wherein the rafter and the support arm are each curved.

18. The awning assembly of claim 15, wherein an outer portion of the mounting arm defines a first slot through which the pivot pin extends, and a second slot through which the spacer pin extends.

* * * * *